US008317285B2

(12) United States Patent
Nubson et al.

(10) Patent No.: US 8,317,285 B2
(45) Date of Patent: Nov. 27, 2012

(54) PRINTER SENSOR SYSTEM

(75) Inventors: Richard C. Nubson, Eden Prairie, MN (US); Luc Debleeckere, Plymouth, MN (US)

(73) Assignee: DataCard Corporation, Minnetonka, MN (US)

( * ) Notice: Subject to any disclaimer, the term of this patent is extended or adjusted under 35 U.S.C. 154(b) by 818 days.

(21) Appl. No.: 11/956,745

(22) Filed: Dec. 14, 2007

(65) Prior Publication Data

US 2009/0153599 A1 Jun. 18, 2009

(51) Int. Cl.
*B41J 29/38* (2006.01)

(52) U.S. Cl. ..... 347/14; 347/5; 347/19

(58) Field of Classification Search ..... 347/14, 347/5, 19

See application file for complete search history.

(56) References Cited

U.S. PATENT DOCUMENTS

| | | | | |
|---|---|---|---|---|
| 4,565,478 | A | 1/1986 | Ericsson | |
| 4,928,133 | A | 5/1990 | Fulton | |
| 5,121,130 | A | 6/1992 | Hempel et al. | |
| 5,326,179 | A | 7/1994 | Fukai et al. | |
| 5,480,136 | A * | 1/1996 | Meyer | 271/176 |
| 5,584,589 | A * | 12/1996 | Adkins et al. | 400/584 |
| 5,612,526 | A | 3/1997 | Oguchi et al. | |
| 6,159,327 | A | 12/2000 | Forkert | |
| 6,261,012 | B1 | 7/2001 | Haas et al. | |
| 6,263,796 | B1 | 7/2001 | Jordan | |
| 6,460,964 | B2 | 10/2002 | Osborne | |
| 6,484,008 | B2 | 11/2002 | Arcaro et al. | |
| 6,655,774 | B2 | 12/2003 | Maruyama | |
| 6,752,493 | B2 | 6/2004 | Dowell et al. | |
| 2003/0030833 | A1 | 2/2003 | Mochizuki et al. | |
| 2003/0197770 | A1 * | 10/2003 | Klinefelter et al. | 347/104 |
| 2004/0066441 | A1 | 4/2004 | Jones et al. | |
| 2004/0109715 | A1 | 6/2004 | Meier et al. | |
| 2005/0140769 | A1 | 6/2005 | Kanemaru et al. | |
| 2005/0206935 | A1 | 9/2005 | Cox et al. | |
| 2006/0007290 | A1 * | 1/2006 | Oshima et al. | 347/102 |

FOREIGN PATENT DOCUMENTS

| | | | |
|---|---|---|---|
| EP | 1 193 075 | | 4/2002 |
| EP | 1 707 392 | | 10/2006 |
| JP | 2002-202654 | A | 7/2002 |
| WO | WO 2005094170 | A2 * | 10/2005 |

OTHER PUBLICATIONS

International Search Report of PCT/US2008/083487, dated May 8, 2009.

Written Opinion of the International Searching Authority of PCT/US2008/083487, dated May 8, 2009.

Supplementary European search report for European patent application No. 08861101.7, dated Jan. 25, 2011 (7 pages).

* cited by examiner

*Primary Examiner* — Laura Martin

(74) *Attorney, Agent, or Firm* — Hamre, Schumann, Mueller & Larson, P.C.

(57) ABSTRACT

A printer that provides improved image placement on documents including identification documents such as identification cards, credit and debit cards, and the like, and passports. The printer eliminates blind moves and mechanism errors to achieve repeatable image placement on the document surface with the correct horizontal image placement dimension. The printer senses an edge of the document to immediately initiate printing. The edge of the document can be either the leading edge or the trailing edge. The edge of the document can also be sensed by a separate sensor to initiate movement of a print head of the print station toward a print position.

7 Claims, 7 Drawing Sheets

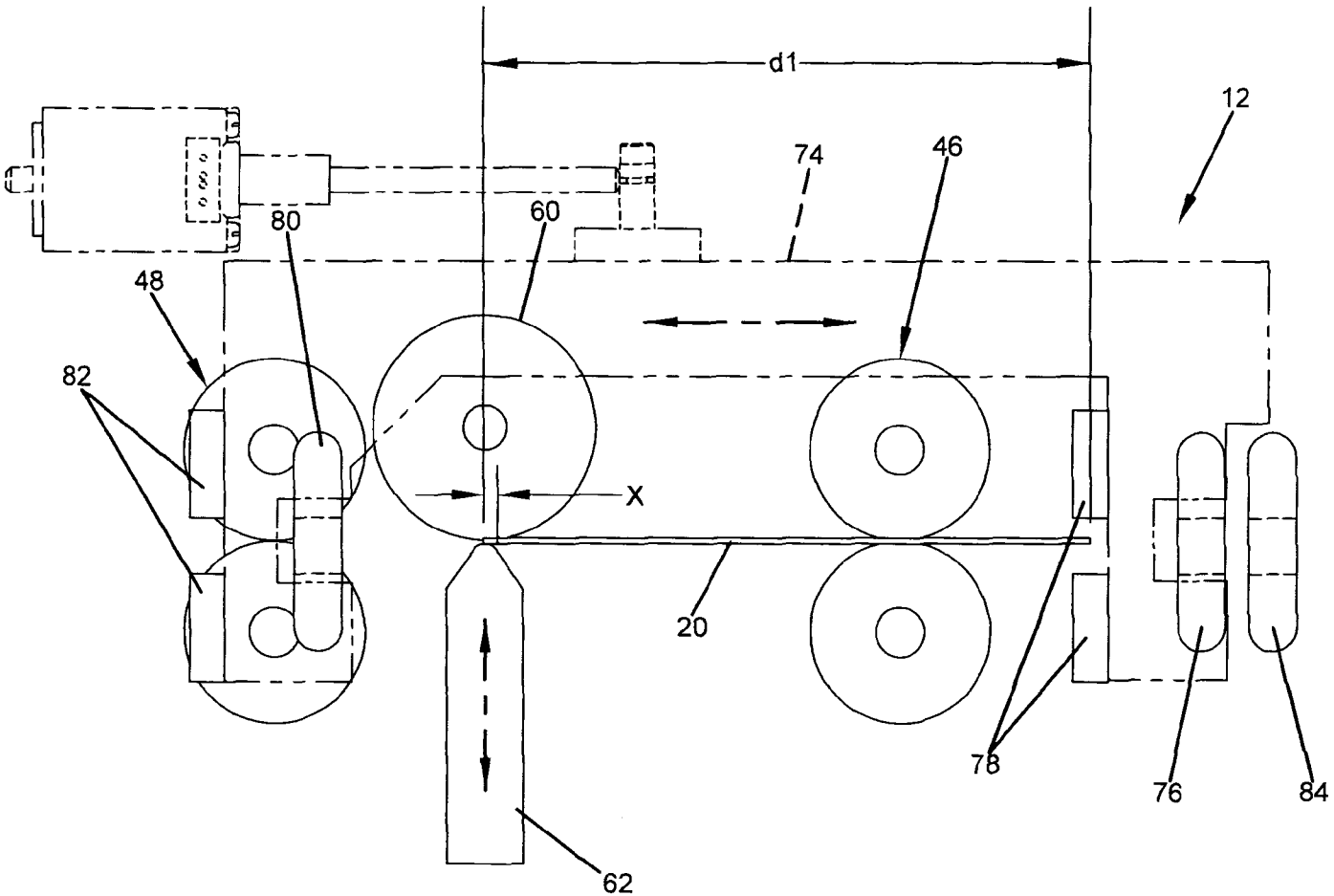
FIG. 5
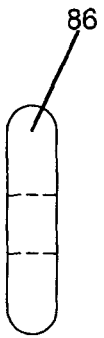

PRINTER SENSOR SYSTEM

FIELD

This disclosure relates to printers and to improving printing on documents, including but not limited to, identification document printers that print on identification documents such as identification cards, credit and debit cards, and the like, and passports.

BACKGROUND

The use of printers for printing on documents is known in a large number of technologies. One example of the use of a printer is printing on identification documents such as identification cards, credit and debit cards, and the like, and passports.

In identification document printers, precise positioning of the printing on the identification document is important for both monochromatic and multi-color printing. In the case of multi-color printing, the printed image, for example text, graphics or a photo, is formed by superimposing layers of yellow, cyan and magenta color to create the resulting multi-color image. In addition, the printed image is often positioned a certain distance horizontally from the leading edge as well as vertically from the bottom edge of the identification document.

In one known identification document printer, the printer uses a sensor to sense the trailing edge of the document as it is transported in the printer. Once the trailing edge is sensed, the printer transports the document an additional distance (termed a blind move) to position the document at which time the printer starts to print on the document on the assumption that the document is properly positioned. However, the blind move of the document by the printer along with mechanism drive errors leads to variability in the positioning of the document and the resulting location of the printing on the document.

SUMMARY

A printer is described that provides improved image placement on documents including identification documents such as identification cards, credit and debit cards, and the like, and passports. The printer eliminates blind moves and mechanism errors to achieve repeatable image placement on the document surface with the correct horizontal image placement.

In one embodiment, a method of printing on a document includes inputting the document into a print station of a printer, sensing an edge of the document, and initiating printing when the edge is sensed. The edge of the document can be either the leading edge or the trailing edge. By initiating printing when the edge is sensed, one knows that the document is properly positioned so that the resulting printed image is properly located on the document. The edge of the document can also be sensed by a separate sensor to initiate movement of a print head of the print station toward a print position.

The concepts described herein can be used on other types of equipment in which precise positioning of a material applied to a document substrate is important. For example, the concepts described herein could be applied to a lamination mechanism for an identification document that applies a laminate to the document substrate, or a retransfer printer that prints onto an intermediate transfer media that is subsequently transferred onto a document substrate.

For example, a method of processing an identification document substrate includes inputting the identification document substrate into a processing station of an identification document processing machine, sensing an edge of the identification document substrate, and initiating application of material to the identification document substrate when the edge is sensed.

In another embodiment, a printer includes a print station having a print mechanism with a print head configured for printing on a document. A document transport mechanism is provided in the print station for transporting a document input into the print station. The printer also includes a first sensor that is capable of sensing an edge of the document to ready the print head for printing, and a second sensor downstream from the first sensor. The second sensor is capable of sensing the edge of the document to initiate printing by the print head. The first sensor and the second sensor are adjustably mounted together for simultaneous change in position within the print station.

Therefore, the positions of the first and second sensors can be changed together, which is useful to account for mechanism errors that may be inherent to the printer and the transport mechanism, and to account for changes in the horizontal location of the image(s) on the document.

DRAWINGS

Figure 4:
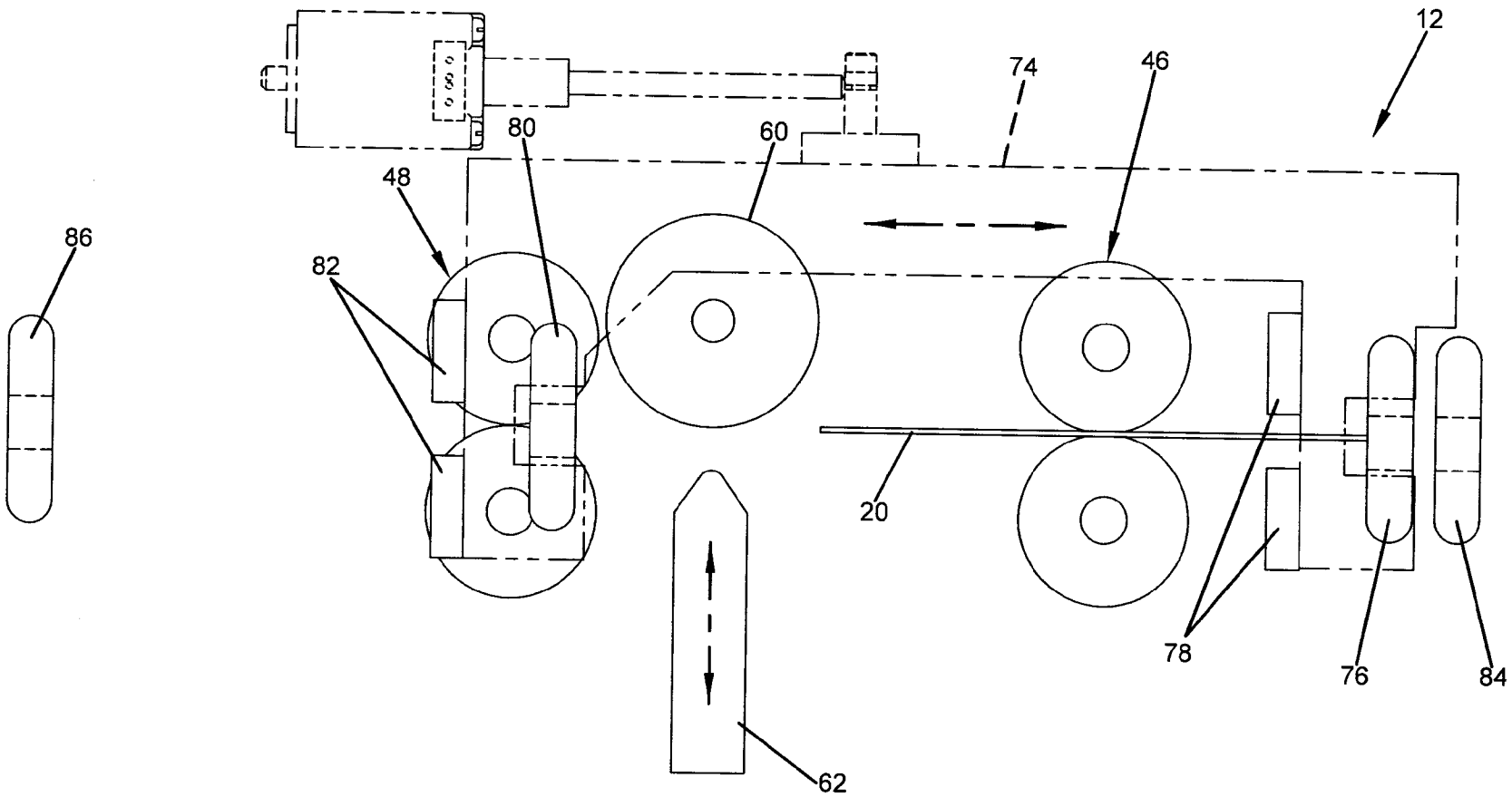

FIG. 4 schematically depicts the print station with a card in position with the trailing edge sensed by a sensor to move the print head toward the card.

FIG. 5 schematically depicts the print station with a card in position with the trailing edge sensed by a sensor to initiate printing.

Figure 6:
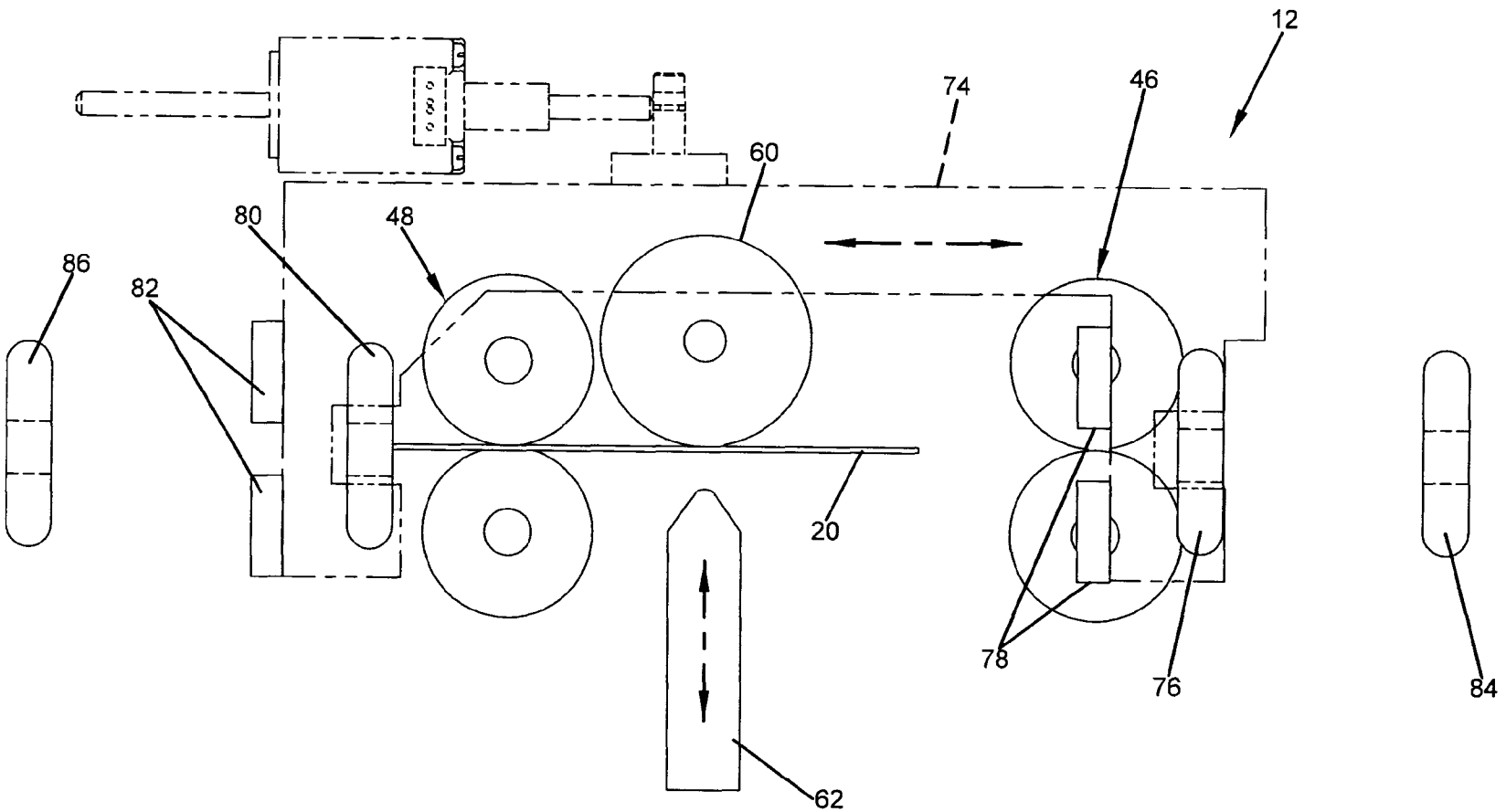

FIG. 6 schematically depicts the print station with a card in position with the leading edge sensed by a sensor to move the print head toward the card.

Figure 7:
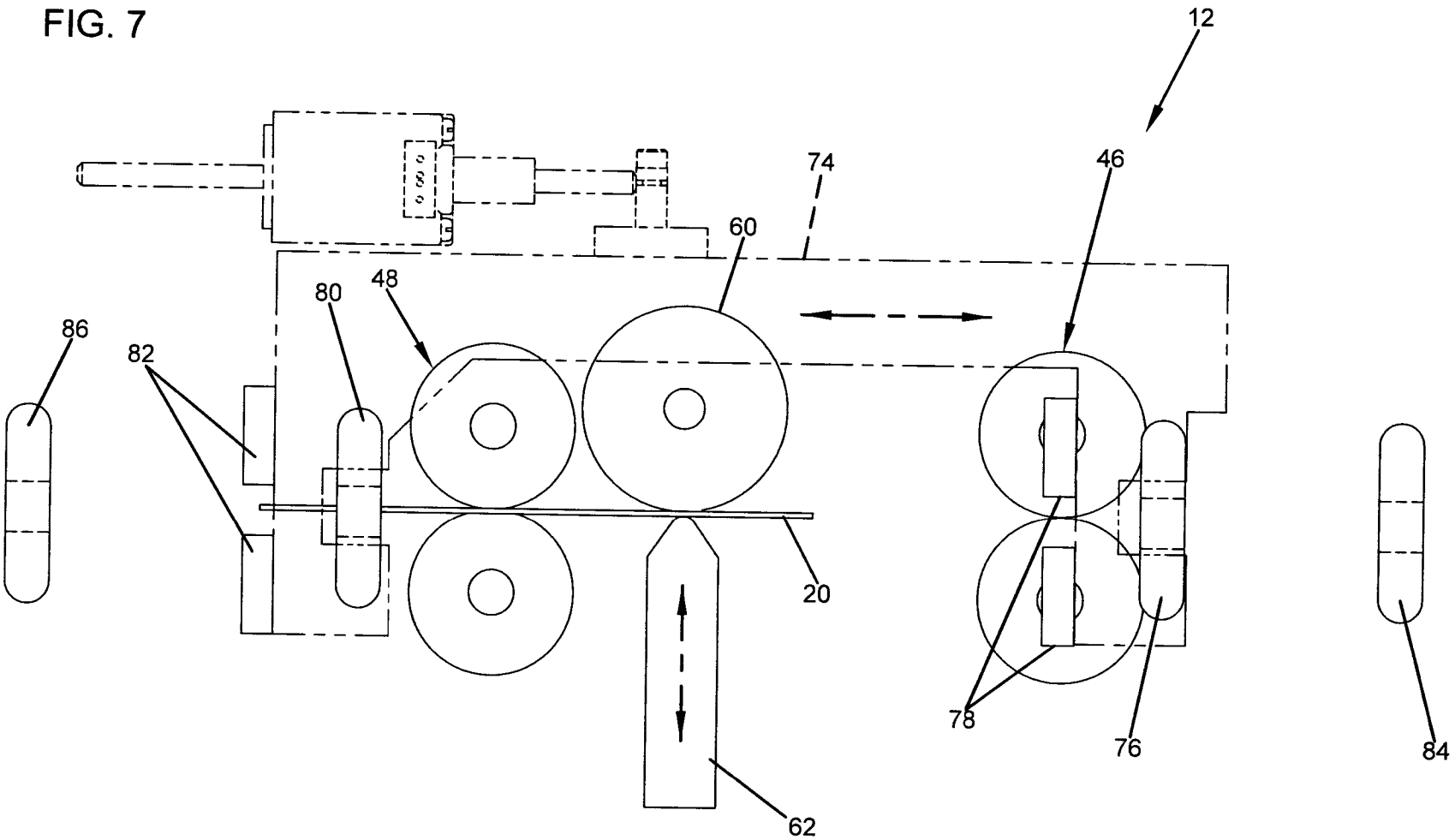

FIG. 7 schematically depicts the print station with a card in position with the leading edge sensed by a sensor to initiate printing.

DETAILED DESCRIPTION

Figure 1:
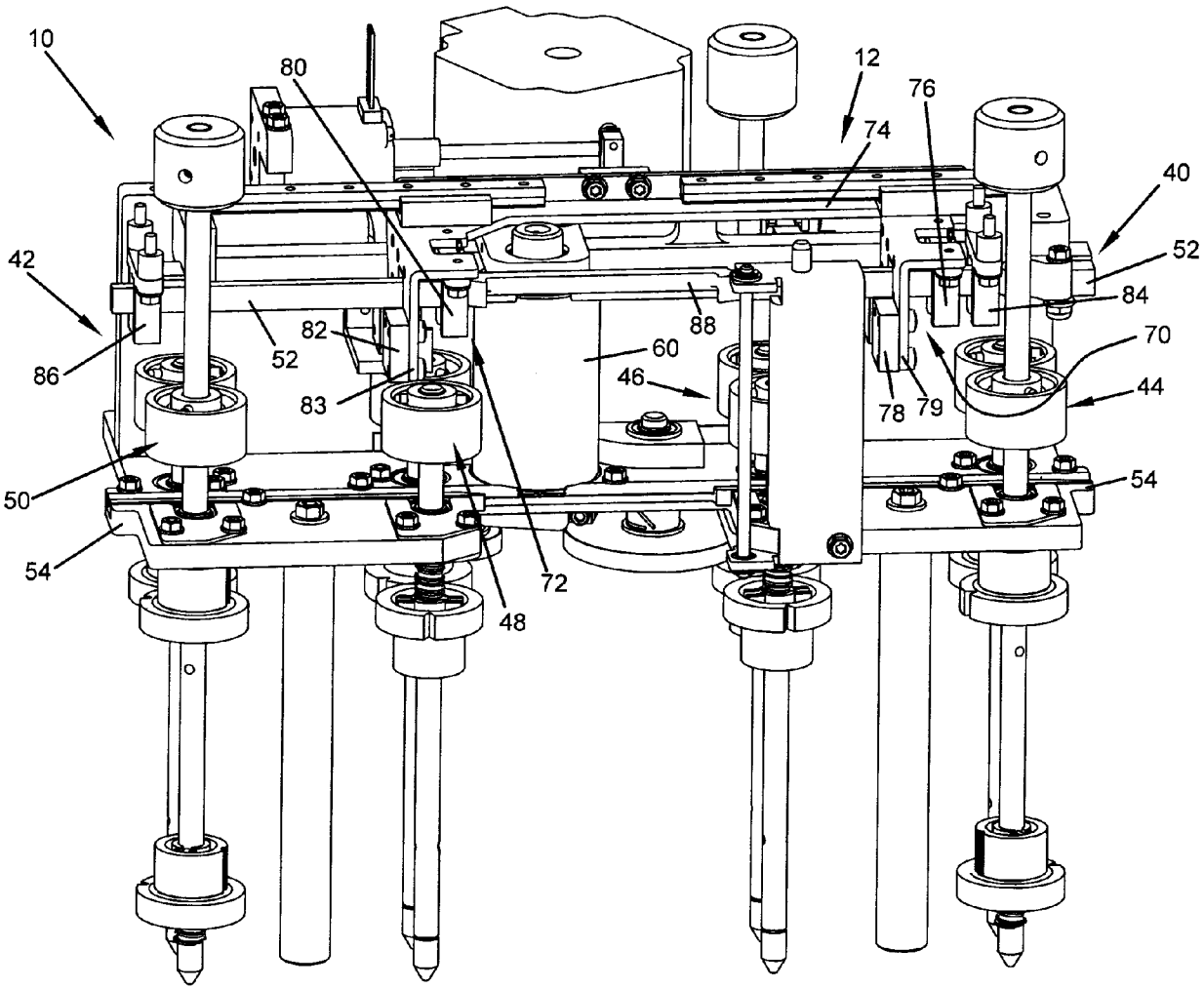
FIG. 1 is a perspective view of a print station of a printer.
Figure 2:
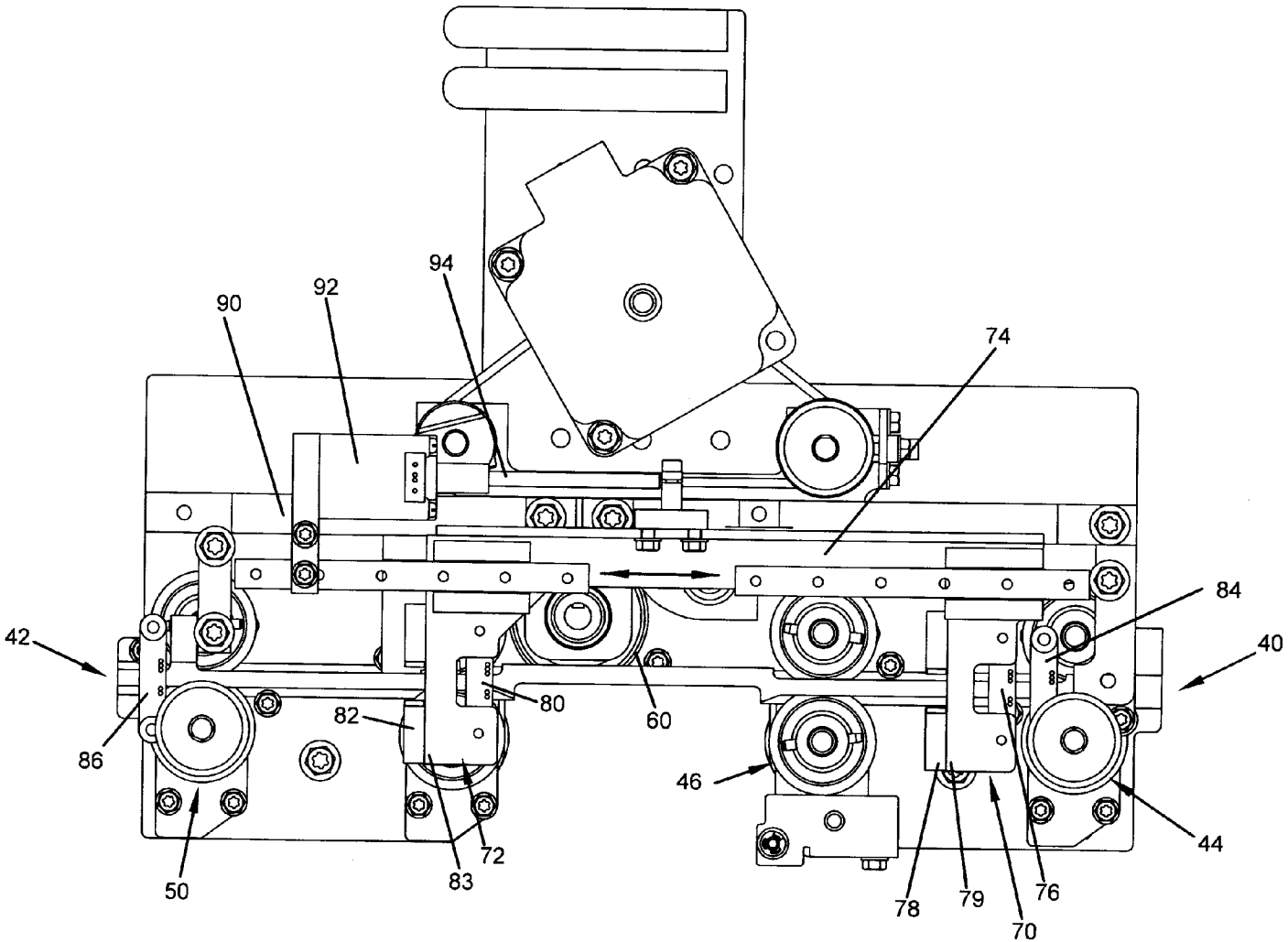
FIG. 2 is a top view of the print station.

A printer 10 having a print station 12 is illustrated in FIGS. 1-2. For sake of convenience, the printer 10 will be described herein as being configured for printing on identification documents. Examples of identification documents include plastic and composite cards, for example identification cards, credit and debit cards, and the like, and passports. To facilitate the description, the document being printed on will hereinafter be described as being an identification card or just a card. The card can be any size of card, for example a CR-80 card, or any shape of card. However, in appropriate circumstances, the concepts described herein can be used on other types of printers that print on other types of documents.

Further, in appropriate circumstances, the concepts described herein can be applied to other types of equipment in which precise positioning of material applied to a document substrate is important. For example, the concepts described herein could be applied to a lamination mechanism for an identification document that applies a laminate to the document substrate, or a retransfer printer that prints onto an intermediate transfer media that is subsequently transferred onto a document substrate.

The printer 10 is constructed as a three module printing system having three serial modules or print stations 12, each print station 12 printing a respective yellow, magenta or cyan (YMC) color using a thermal dye diffusion process. Only one station 12 that prints one color is illustrated for sake of clarity, for example the first station 12, it being understood that there are additional stations 12 downstream from the illustrated station, each station printing a different color on the card as the card is transported through each station. If considered necessary, a separate print station 12 for printing black logos, text and the like can also be provided. In the printer, once the station completes printing one color of the image, the card is transported to the next print station to print the next color of the image, and then transported to the next station to print the next color, etc.

In alternative embodiments, the sensor system described herein can be used in a reversing printing system such as disclosed in U.S. Pat. No. 5,584,589 in which a multi-color panel YMCK ribbon is used and the card is printed in multiple passes through a single print station, or in any other printing system.

Figure 3:
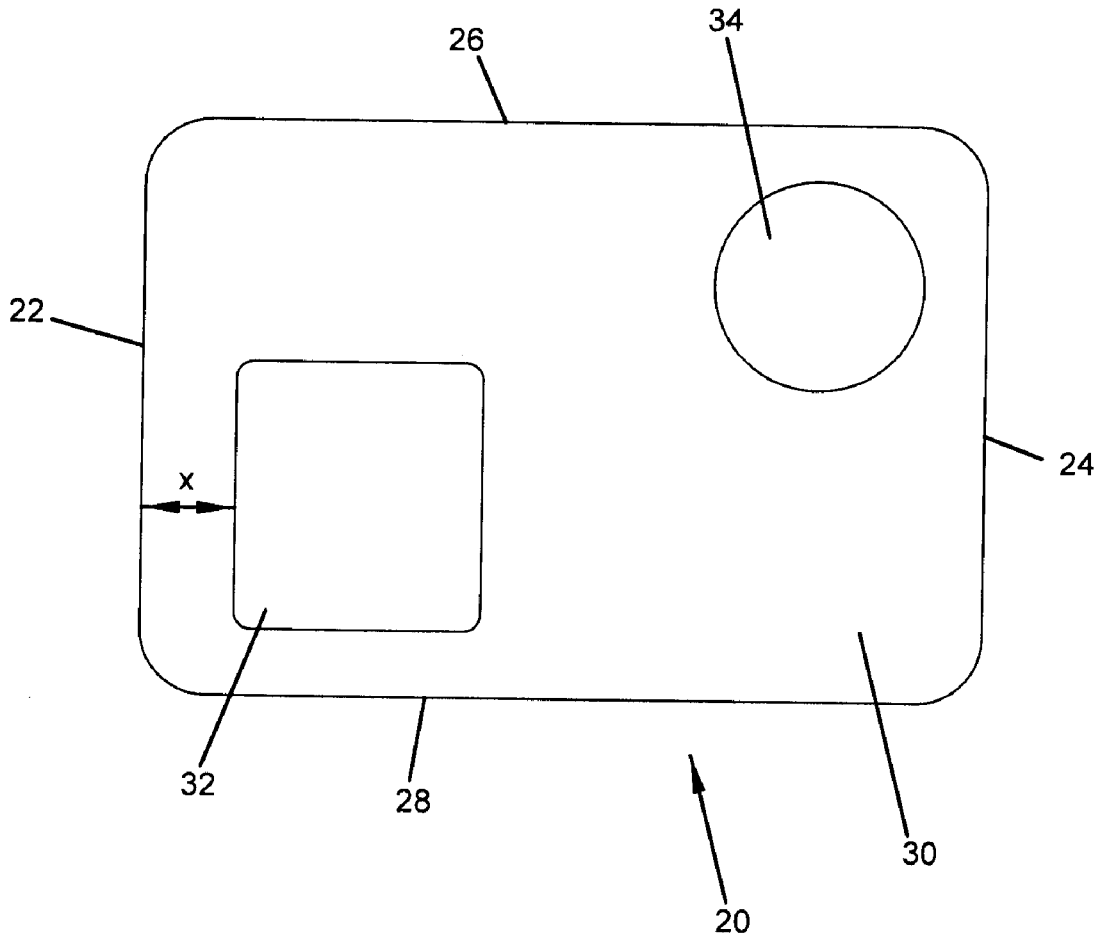
FIG. 3 illustrates an exemplary document with printing.

An identification card 20 is illustrated in FIG. 3. The card 20, the composition and construction of which are well known, includes a leading edge 22, a trailing edge 24, side edges 26, 28, a front surface 30, and a rear surface (not visible). The words leading and trailing are in reference to the direction of the card as it is transported through the station 12. In certain instances, if the card is oriented during transportation such that the side edges 26, 28 are arranged vertically, one of the side edges can be considered the leading edge while the other side is the trailing edge.

In the illustrated card 20, the front surface 30 is provided with one or more printed images, for example a photo 32, a logo 34, text, or other printed images. The images can be monochromatic and/or multi-color. In the case of a multi-color image, for example the photo 32 and the logo 34, the image is formed by superimposing layers of yellow, cyan and magenta color to create the resulting multi-color image. This description will describe the images 32, 34 as being multi-color images formed by a suitable thermal printing technique such as dye diffusion printing. Other types of printing techniques can be used, for example ink jet, laser or thermal transfer.

The printing that forms the photo 32 starts a horizontal distance "x" from the leading edge 22. The photo 32 further has a vertical dimension referenced from the bottom edge 28. The specific value of "x" can vary anywhere from substantially zero, whereby the printed image starts from the edge 22, up to a predetermined value depending upon user and equipment specifications.

When two or more images are printed on a card at the same time, the data necessary to print the images are typically provided in one data file. Thus, the separate images are effectively one image from the same data file. In that situation, there is only one horizontal location dimension "x" of concern, and the images are printed based on the data contained in the data file.

Returning to FIGS. 1 and 2, the print station 12 includes a card infeed side 40 from which a card enters the print station 12 and a card outfeed side 42 from which a card exits the print station on its way to the next print station. Between the infeed side 40 and the outfeed side 42 is a document transport mechanism that includes transport roller pairs 44, 46, 48, 50 that transport the card within the print station, and guides 52, 54 that guide the edges 26, 28 of the card during transport.

A print mechanism (not visible in FIGS. 1 and 2) is provided for printing on the card. In the illustrated embodiment, the print mechanism is a thermal print mechanism for performing thermal printing on the card. The print mechanism is a standard thermal print mechanism including a print roller 60 (FIGS. 4-7) that is disposed behind the card during printing to support the card, a thermal print head 62 (FIGS. 4-7) that is mounted for movement toward and away from the print roller 60, and a print ribbon for the particular color of the station.

A first set of sensors 70 is disposed upstream of the print mechanism for sensing the trailing edge 24 of the card 20, and a second set of sensors 72 is disposed downstream of the print mechanism for sensing the leading edge 22 of the card. The sensors 70, 72 are disposed at opposite ends of a yoke 74 that is movably mounted in the print station 12. The yoke 74 permits adjustment in the positions of the sensors 70, 72 in the print station 12. In appropriate circumstances, the sensors 70, 72 may also be independently adjustable. This would allow more freedom for longer print media, and allow for the sensors to be staged in a position that minimizes the time to move to a target commanded location. In addition, the print station 12 can be simplified by using only one of the sensor sets 70 or 72.

The sensors 70 comprise a sensor 76 for sensing the trailing edge 24 of the card when appropriate, and when the trailing edge is sensed, sending a signal that results in the print head 62 being actuated toward the print roller 60 to a print position. The sensors 70 also comprise a sensor 78 that is spaced from the sensor 76 a fixed distance for sensing the trailing edge of the card when appropriate. The sensors 76, 78 are mounted on a bracket 79 that is fixed to the yoke 74. When the trailing edge is sensed by the sensor 78, a signal is sent to the print mechanism to initiate printing.

The sensors 72 comprise a sensor 80 for sensing the leading edge 22 of the card when appropriate, and when the leading edge 22 is sensed, sending a signal that results in the print head 62 being actuated toward the print roller 60 to a print position. The sensors 72 also comprise a sensor 82 that is spaced from the sensor 80 a fixed distance for sensing the leading edge of the card when appropriate. The sensors 80, 82 are mounted on a bracket 83 that is fixed to the yoke 74. When the leading edge is sensed by the sensor 82, a signal is sent to the print mechanism to initiate printing.

When the trailing edge or leading edge are sensed by the sensors 78, 82, printing is immediately started, discounting delays inherent in sending and processing signals and other delays inherent to a computer controlled printer. For example, it is estimated that the delay is approximately 10 to 100 microseconds.

A sensor 84 is also provided adjacent the infeed side 40 for sensing when a card enters the print station 12, and a sensor 86 is provided adjacent the outfeed side 42 for sensing when a card exits the print station 12 on its way to the next print station.

The sensors 76, 78, 80, 82, 84, 86 can be any type of sensors suitable for performing the required functions of the respective sensor. For example, the sensors can be fiber optic photo cells.

The yoke 74 is linearly actuatable in the direction of the arrows parallel to the transport direction of the card. The brackets 79, 83, which are fixed at opposite ends of the yoke 74 and move therewith, are guided by a linear rail with ball bearing mounting block 88, while a main body of the yoke 74 is slidably supported on a track 90. The yoke 74 is actuated by a drive motor 92 and a drive shaft 94 driven by the motor 92.

An exemplary operation of the printer 10 is as follows. This example assumes that the image data is provided as one data file that dictates the printing on the entire card surface regardless of the number of distinct images. Alternatively, the data for each image can be provided separately in its own image file so that each image is printed based on its own image file.

A card 20 to be printed on is input into the print station 12 through the infeed side 40. If printing is to begin on the leading half of the card 20, the sensors 76, 78 will be used to control printing on the entire card surface. However, if the printing begins on the rear half of the card, then the sensors 80, 82 will be used to control the printing.

Turning now to FIGS. 4-5, a card 20 is shown as having entered the print station 12. The sensor 84 will have sensed entry of the card to let the equipment know that a card is present. FIG. 4 illustrates the card 20 transported to a position where the trailing edge 24 is sensed by the sensor 76. When the sensor 76 senses the trailing edge, a signal is sent to the print station controller to start actuating the print head 62 toward the print roller 60 to its print position. As the card 20 continues to be fed, the trailing edge 24 is sensed by the sensor 78 as shown in FIG. 5. When the sensor 78 senses the trailing edge 24, printing is immediately initiated. At this time, the print head 62 is in proper printing position and the card is properly positioned so that the image begins at the correct horizontal position on the card. The positions of the sensors 76, 78 have been set so that the distance "d1" from the sensor 78 to the midpoint of the print roller 60 is equal to the length of the card measured between the leading edge 22 and the trailing edge 24 minus any distance "x" so that the printing starts on the card at the correct distance "x" from the leading edge.

Prior to printing, the print station 12 is calibrated by determining the true relative positions of the print head 62 and the electrical center of the sensor 78. This absolute distance between the print head 62 with respect to the electrical center of the sensor 78 forces the printer to place the image on the card surface at an absolute commanded position. The dimensional variability of the mechanical system is the toleranced variable distance between the thermal print head 62 and a fixed homing flag for the sensor 82. The sensor 82 is used for the homing of the yoke 74 which connects the combined sensors 82 and 78. The sensor 82 is used as a homing sensor because an incoming card with a new/different image position will block the sensor 78. This card present situation renders sensor 78 covered and unusable for home positioning of the sensor system. Each set of sensors 78 and 82 will have a correctional dimension either added or subtracted to place the sensor at the required "d1" dimension. This correctional dimension is determined by printing a test card. This described calibration process is a manual procedure. Once the calibration is performed, the printer will print repeatable and accurately. However, other calibration procedures could be performed.

In addition, the position of the sensors 76, 78 is adjusted to account for the horizontal positioning "x" from the leading edge 22. If the distance "x" is zero, only the correctional dimension from the calibration is factored in. If the distance "x" is non-zero, then the correctional dimension is adjusted by the distance "x".

The print station 12 will print one color necessary for the images 32, 34 in one pass and the sensors 76, 78 will control the printing operation. The sensors 80, 82 will not be functional in this case. After printing in the station, the card is then transported to the next print station to print the next color, and then transported to a third print station, etc. until the images have been completely printed will all appropriate colors. In the second and subsequent print stations, the sensor 76 will again sense the trailing edge 24 to initiate movement of the print head 62 toward the print roller 60 to its print position, and the sensor 78 will sense the trailing edge 24 to initiate printing of the second color.

With reference to FIGS. 6 and 7, if the printing does not start until the second half of the card, the sensors 80, 82 can be used to control the printing. In this instance, the sensors 76, 78 will not be functional. As shown in FIG. 6, when the sensor 80 senses the leading edge 22, a signal is sent to the print station controller to start actuating the print head 62 toward the print roller 60 to its print position. As the card 20 continues to be fed, the leading edge 22 is sensed by the sensor 82 as shown in FIG. 7. When the sensor 82 senses the leading edge 22, printing is immediately initiated. At this time, the print head 62 is in proper printing position. The positions of the sensors 80, 82 have been set so that the card is in proper position such that when the leading edge is sensed, printing initiates at the correct horizontal location oil the card surface.

The invention may be embodied in other forms without departing from the spirit or novel characteristics thereof. The embodiments disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A printer that is configured to print an identification card or a passport, comprising:

a print station having a print mechanism with a print head configured for printing on the identification card or the passport;

a transport mechanism in the print station that transports the identification card or the passport input into the print station in a transport direction;

a first sensor capable of sensing an edge of the identification card or the passport to ready the print head for printing;

a second sensor downstream from the first sensor in the transport direction and spaced from the first sensor by a fixed distance, the second sensor capable of sensing the edge of the identification card or the passport to initiate printing by the print head;

the first sensor and the second sensor are adjustably mounted together for simultaneous change in position in the transport direction within the print station so that the fixed distance between the first sensor and the second sensor remains the same; and the first sensor and the second sensor are disposed on an upstream side of the print mechanism and sense a trailing edge of the identification card or the passport; and further comprising a third sensor that is capable of sensing a leading edge of the identification card or the passport to ready the print head for printing, and a fourth sensor downstream from the third sensor, the fourth sensor is capable of sensing the leading edge of the identification card or the passport to initiate printing by the print head; the third sensor and the fourth sensor are disposed on a downstream side of the print mechanism; and the third sensor and the fourth sensor are adjustably mounted together for simultaneous change in position in the transport direction within the print station.

2. The printer of claim 1, wherein the first sensor, the second sensor, the third sensor and the fourth sensor are mounted for simultaneous change in position in the transport direction.

3. The printer of claim 1, wherein the print mechanism includes a print roller, the print head is moveable toward and away from the print roller, and the first sensor causes actuation of the print head toward the print roller when the edge is sensed.

4. The printer of claim 1, further comprising a sensor, separate from the first sensor and the second sensor, that senses the identification card or the passport in the print station.

5. A printer, comprising:

a print station having a print mechanism with a print head configured for printing on a document;

a document transport mechanism in the print station that transports a document input into the print station in a document transport direction;

a first sensor capable of sensing an edge of the document to ready the print head for printing;

a second sensor downstream from the first sensor in the document transport direction, the second sensor capable of sensing the edge of the document to initiate printing by the print head;

the first sensor and the second sensor are disposed on an upstream side of the print mechanism and sense a trailing edge of the document and are adjustably mounted together for simultaneous change in position in the document transport direction within the print station;

a third sensor that is capable of sensing a leading edge of the document to ready the print head for printing;

a fourth sensor downstream from the third sensor, the fourth sensor is capable of sensing the leading edge of the document to initiate printing by the print head;

the third sensor and the fourth sensor are disposed on a downstream side of the print mechanism; and the third sensor and the fourth sensor are adjustably mounted together for simultaneous change in position in the document transport direction within the print station.

6. The printer of claim 5, wherein the first sensor, the second sensor, the third sensor and the fourth sensor are mounted for simultaneous change in position in the document transport direction.

7. The printer of claim 1, wherein the printer is configured to initiate printing on the identification card or the passport when the edge is sensed by the second sensor discounting delays in sending and processing signals and other delays inherent to the printer and without further transporting the identification card or the passport in the printer between the time of sensing the edge by the second sensor and printing beginning on the identification card or the passport.

* * * * *